US007283084B2

(12) United States Patent
Di Peppe

(10) Patent No.: US 7,283,084 B2
(45) Date of Patent: Oct. 16, 2007

(54) METHOD AND SYSTEM FOR APPLIANCES REMOTE CONTROL

(75) Inventor: Pierluigi Di Peppe, Brescia (IT)

(73) Assignee: Genesis S.r.l. (IT)

( * ) Notice: Subject to any disclaimer, the term of this patent is extended or adjusted under 35 U.S.C. 154(b) by 122 days.

(21) Appl. No.: 10/520,757

(22) PCT Filed: Jul. 16, 2003

(86) PCT No.: PCT/IT03/00441

§ 371 (c)(1),
(2), (4) Date: Jan. 7, 2005

(87) PCT Pub. No.: WO2004/008412

PCT Pub. Date: Jan. 22, 2004

(65) Prior Publication Data

US 2005/0200499 A1 Sep. 15, 2005

(30) Foreign Application Priority Data

Jul. 16, 2002 (IT) ..... BS2002A0064

(51) Int. Cl.
*G08C 19/12* (2006.01)

(52) U.S. Cl. ..... 341/176; 340/825.69; 340/825.72; 348/734

(58) Field of Classification Search ..... 341/173, 341/176; 340/825.69, 825.72; 348/734
See application file for complete search history.

(56) References Cited

U.S. PATENT DOCUMENTS 5,544,979 A 8/1996 White (Continued)

FOREIGN PATENT DOCUMENTS

EP 0 503 699 9/1992

(Continued)

OTHER PUBLICATIONS

IBM Corp. New York, U.S., Apr. 1, 1993, Device Selection Indicator with Remote Control, IBM Technical Disclosure Bulletin.

*Primary Examiner*—Albert K. Wong
(74) *Attorney, Agent, or Firm*—McGlew & Tuttle, PC

(57) ABSTRACT

Remote control system for electric or electronic appliances comprising at least one remote control that can be actuated by a user and at least one electronic apparatus installed on each of said appliances and intended to communicate by air with said remote control to actuate a status change of the appliance selected by the user, characterized in that said electric apparatus of each appliance comprises at least: a transmitter (13) intended to transmit a message by air to the remote control; a receiver (14) intended to receive and decode a message sent by air by the remote control; and—an identification address (16) that said electronic apparatus is capable of transmitting by the transmitter, and in that at least one remote control comprises: a transmitter (17) intend to transmit a message by air to the electric or electronic appliances, a receiver (18) intended to receive and decode a message sent by air by at least one of said appliances and having an aiming axis to be aimed towards an appliance to be controlled; and at least one key or similar device to allow the user to send an actuation command to a selected appliance, wherein the remote control receiver is provided with a directional receiving device to allow the reception only of the signals coming from sources located outside a cone with axis coinciding with the remote control aiming axis.

15 Claims, 3 Drawing Sheets

U.S. PATENT DOCUMENTS

| | | | | |
|---|---|---|---|---|
| 5,949,351 | A | 9/1999 | Hahm | |
| 7,053,798 | B2 * | 5/2006 | Popineau | 341/20 |

FOREIGN PATENT DOCUMENTS

| | | | |
|---|---|---|---|
| EP | 0 734 197 | B1 | 9/1996 |
| EP | 1 058 219 | | 12/2000 |
| GB | 2 259 172 | | 3/1993 |
| WO | WO 01/35368 | A2 | 5/2001 |
| WO | WO 010897 | * | 7/2002 |

* cited by examiner

METHOD AND SYSTEM FOR APPLIANCES REMOTE CONTROL

The present invention relates to remote controlled electric or electronic appliances and in particular, it relates to a remote control and related receiving apparatus for such appliances. Moreover, another object of the finding is a new remote control method.

PRIOR ART

At present, a user-controlled infrared source (remote control) and an infrared receiver installed on the device to be controlled are used for the remote control of electric or electronic appliances. The remote control turns the infrared source on or off, coding the control sent by the user, whereas the receiving circuit on board of the controlled device decodes the signal received and actuates it, if correct. If more devices are to be controlled, it is necessary to have one remote control for each device or a single remote control with one or more keys for each device. It is clear that as the number of appliances to be controlled increases, both possibilities are not free from evident disadvantages. In the second case, moreover, the system consisting of the single remote control and of the devices associated to it is not freely expandable, that is, if a new device is added, it is necessary to replace or reprogram the remote control.

Some solutions have already been proposed to solve these problems. For example, documents EP 0734 197 B1, U.S. Pat. No. 5,554,979, EP 0 503 699 A1 disclose a remote control intended to send a beam aimed at the object to be turned on or off with a narrow transmission angle. Such solution, however, exhibits the problem of having to provide a receiver having a very wide reception angle, in order to allow the use of this system from any angle. Moreover, no appliance addressing device is provided in these documents (that is, the aimed object has no address of its own), thereby affecting the system expansibility and integrability.

Another solution proposed (for example in document GB 2 259 172 A) provides for every object to be controlled to be provided with its own address. The connection and the subsequent control of the object to be piloted occurs by a method that scans all the addresses of all potentially listening appliances. The detection of the object to be controlled occurs, for example, thanks to a light indicator located on the object itself. This solution exhibits the disadvantage of being slow in terms of time, and of operating only in environments wherein the remote control already knows the addresses to be scanned; in other words, the environment must be known.

Yet another solution (see for example EP 1 058 219 A1) uses the scanning method mentioned above to acquire the knowledge of the environment and thereby program the remote control. In this way it is possible to obtain a remote control capable of learning the address of the devices to which it will send the commands. However, this solution requires programming the remote control every time the type and number of appliances to be controlled are changed, in other words, when the user is in a new environment.

OBJECTS AND SUMMARY OF THE INVENTION

Object of the present invention is that of proposing a method and a system for the remote control of electric or electronic appliances, which should allow controlling a plurality of such appliances by a single remote control, the appliances being provided with a suitable receiving apparatus, without the need of providing the remote control with keys and information corresponding to each appliance to be controlled.

The advantages of such a system are evident. For example:

- with a very small sized remote control it is possible to control an indefinite number of appliances;
- when new appliances are added it is not necessary to replace or change the remote control since this does not need any keys and information related to the appliance;
- an electric system based on such remote control system is easy to expand since the addition of new appliances only requires the line voltage segments to power the appliance itself, while no connections to switches are required.

These and other objects and advantages of the inventions are achieved by a method and a system for the remote control of electric or electronic appliances conforming to the appended claims.

BRIEF DESCRIPTION OF THE DRAWINGS

Further features of the finding will appear more clearly from the following description, made with reference to the attached indicative and non-limiting drawings. In such drawings.

DETAILED DESCRIPTION OF THE INVENTION

Figure 1:
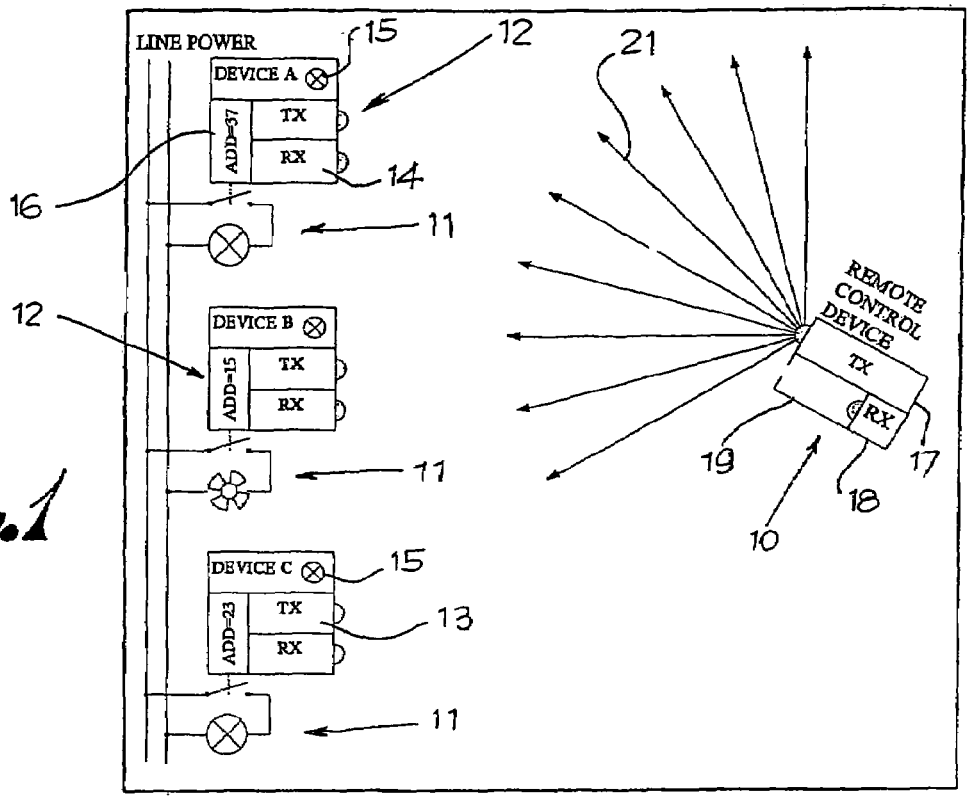
FIG. 1 schematically shows the remote control system for electric or electronic appliances in a first step of request of identification of such appliances by the remote control.

The remote control system under discussion comprises a remote control 10 and a plurality of remote electric or electronic appliances 11 to be controlled, each provided with a respective electronic apparatus 12 intended to support the communication with the remote control 10. In particular, each electronic apparatus 12 comprises:

- a transmitter 13;
- a receiver 14;
- a light indicator 15; and
- an address 16.

On the other hand, the remote control is provided with:

- a transmitter 17 capable of transmitting messages with or without recipient.

The messages without recipient will be processed by all remote devices in listening status, whereas those with recipient will only be processed by the device having the same address as that coded in the message;

- a receiver 18 having a very narrow reception angle. This feature of the receiver can be obtained, for some types of radiation, by placing before a normal receiver a device, such as a pipe 19, suitably shaped, and/or a lens and/or a collimation hole, capable of sending to the same receiver only signals coming from sources located into a very narrow cone 20 with respect to a certain axis X (for example, coinciding with the axis of pipe 19). Such axis therefore becomes the receiver aiming axis, whereas the receiving cone is also the remote control's action cone; and at least one key, not shown.

The communication between remote control and remote appliance takes place by air through known methods, such as infrared beams or radiofrequency. It should be noted that the communications between remote control and remote appliances and vice versa must not necessarily occur in the same way. For example, the communication between remote appliances and remote control can be of the infrared type while the communication between remote control and remote appliances can be by radiofrequency. The important point is that receiver 18 of the remote control must have a very narrow reception angle.

By the remote control and the remote appliances described above, the remote control of such appliances occurs according to the following sequence of actions.

The user aims the remote control towards the selected appliance, and presses a key so that the remote control transmits a message 21 of "general call" requesting all appliances in listening status and within the remote control range of action to transmit their address 16 (FIG. 1).

Figure 2:
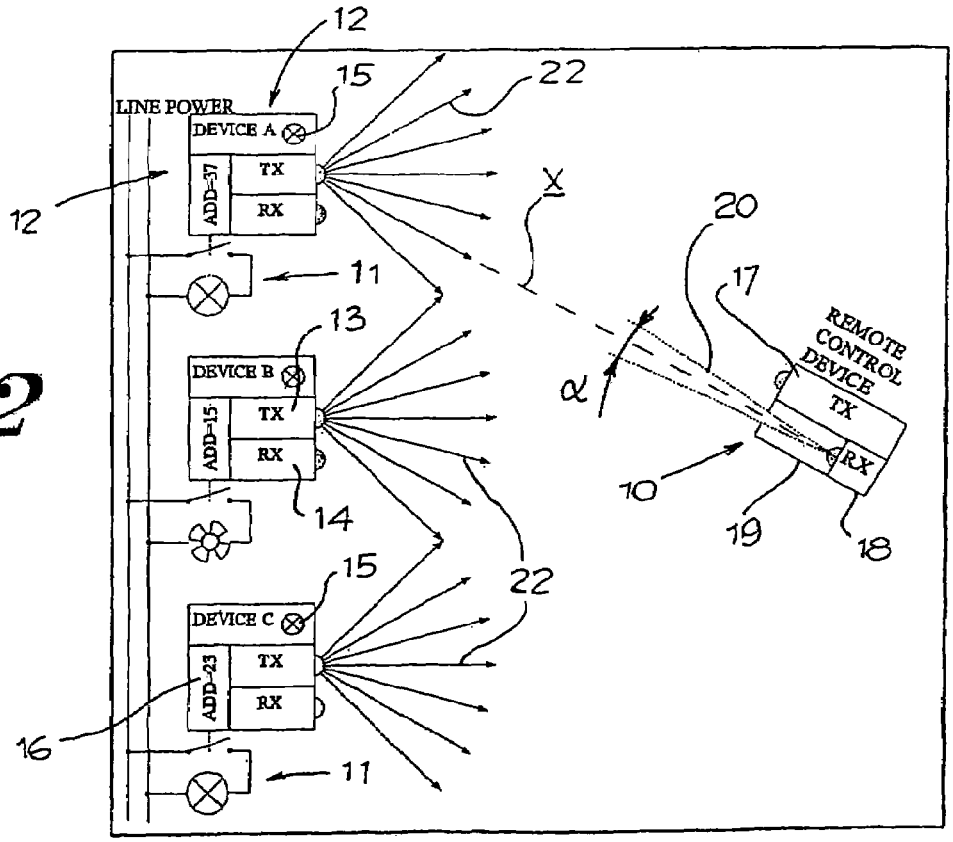
FIG. 2 schematically shows the system in a second step of reception of the address of the appliances to be controlled by the remote control.

All remote appliances that have received the message, and among these certainly that aimed at by the remote control, send a message 22 containing their address (FIG. 2).

Thanks to the narrow reception angle a of its receiver, the remote control only receives the message coming from the appliance aimed at by it. By decoding the message, the remote control acquires address 16 of the appliances selected by the user. From that moment on, all messages sent by the remote control will be of the type with recipient, so that up to the end of the process, that is, until the remote appliance has actuated the command, its communications will only take place with the electronic apparatus of the appliance identified in this step.

Figure 3:
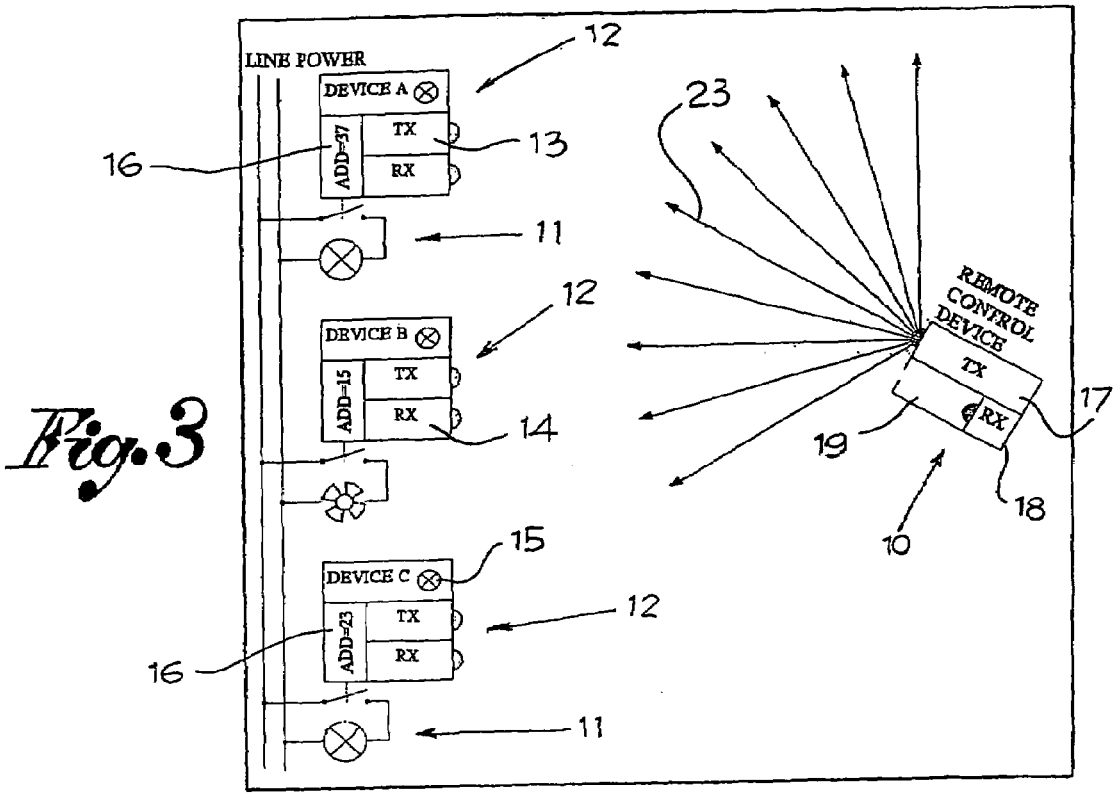
FIG. 3 schematically shows the system in a third step of request of confirmation of the connection by the remote control to the appliances to be controlled.

At this point, the remote control transmits an identification request message 23 whose recipient is the appliance whose address has been received and decoded by the remote control during the previous step. In the practice, for example, message 23 contains the request of activation of the light indicator 15 installed on the selected appliance (FIG. 3).

Figure 4:
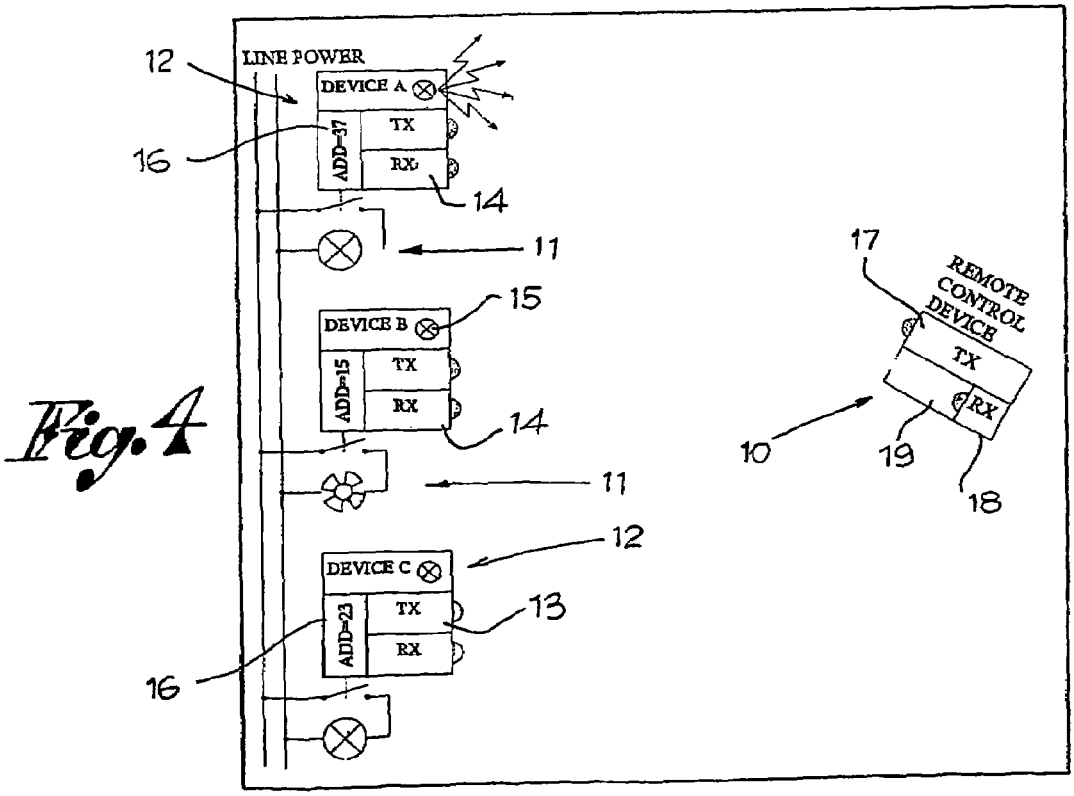
FIG. 4 schematically shows the system in a fourth step of confirmation of the connection with the remote control by the appliance to be controlled.

Receivers 14 of the remote appliances receive message 23 by the turn on command for the light indicator is only actuated by the aimed appliance, since it is the only one with the address equal to that contained in the message. The indicator visually informs the user of the proper aiming of the remote control (FIG. 4).

Figure 5:
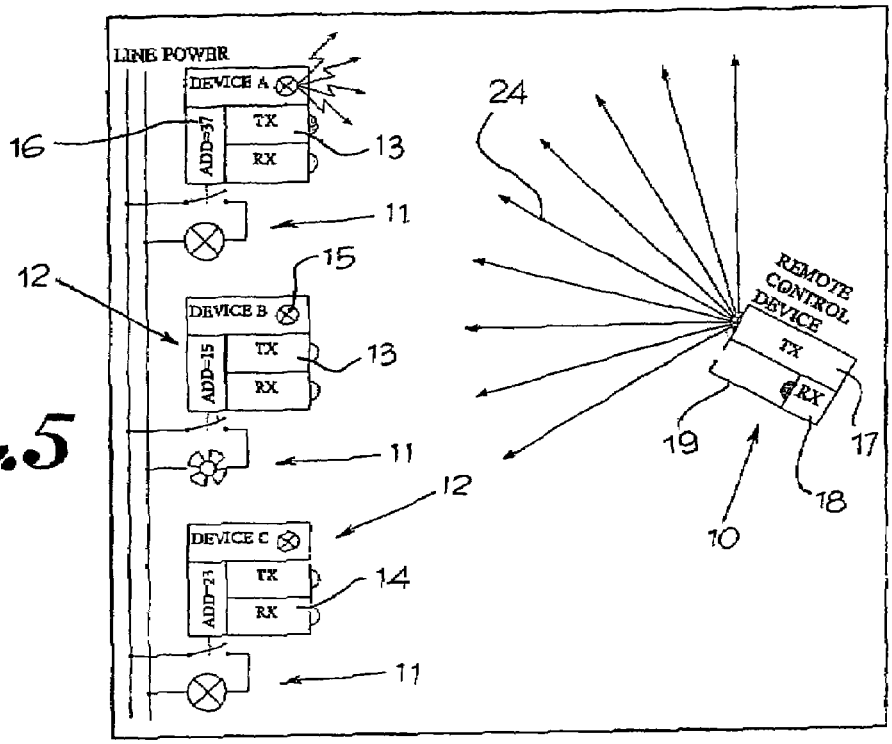
FIGS. 5 and 6 schematically show the system in the real control step of the selected appliances.

At that point the user, certain of the proper selection of the appliance, can use a key, a wheel, a joystick or other device to request the remote control to send the real actuation command. The remote control then sends an actuation message 24 with the appliance having the previously identified address as recipient (FIG. 5).

Figure 6:
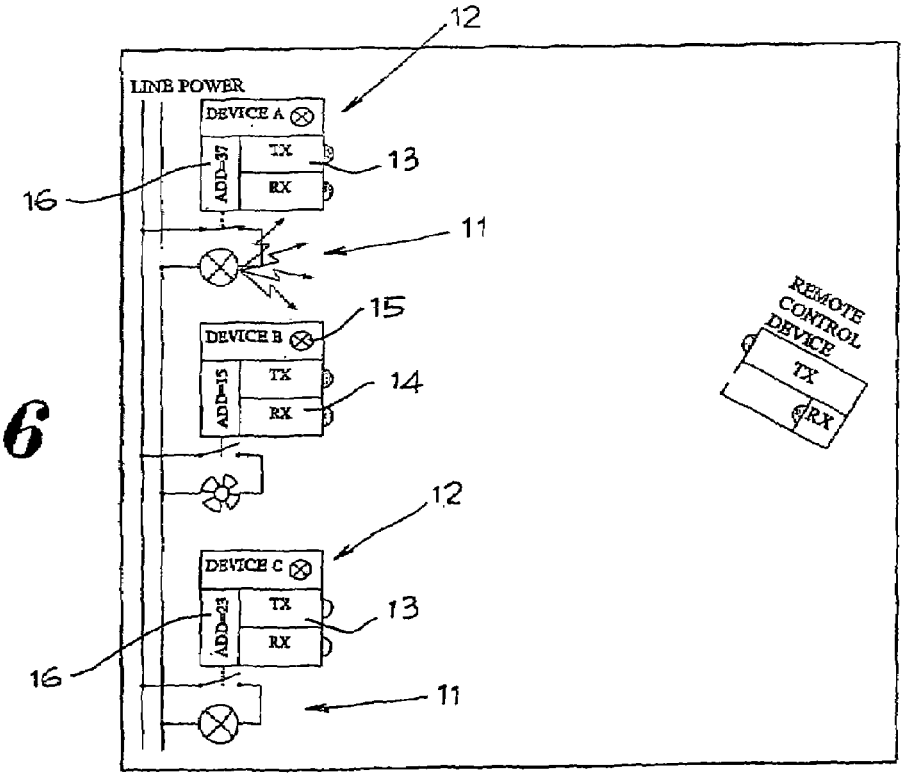

Also in this case, the actuation command 24 is certainly received by multiple appliances but is only actuated by that aimed at, since it is the only one with the address 16 equal to that contained in the message. Finally, as the command is actuated, the remote control turns the light indicator off (FIG. 6).

It should be noted that the intermediate identification request step described above is not strictly necessary for the system operation, but it prevents the situations in which, if the remote control has not been perfectly aimed at the appliance to be controlled and therefore no connection has been established with it, the user uselessly keeps pressing the remote control key. Moreover, it allows accepting aiming inaccuracies during the transmission of the actuation command 24, since if the light indicator 15 is on, the appliance has been linked.

A variant of the remote control method described above will now be described, considering the particular and highly unlikely situation in which more remote appliances are within the remote control reception cone 20. This situation could in any case be avoided by the installer, by suitably arranging the appliances at a certain distance from each other, or by the user, moving closer or away so as to not have a plurality of objects within the reception cone.

In any case, a simple procedure will now be proposed, that allows the remote control to identify one by one all appliances located within its reception cone.

The user aims the remote control to a zone wherein there are other appliances besides the selected one, and requests the remote control to transmit the message 21 of "general call" commanding all appliances in the listening status and within the remote control range of action to transmit their address.

All remote appliances that have received the message, and among these, also those in the remote control cone of action, send a message 22 containing their address (FIG. 2).

The remote control receives at least one address ADD1, stores it and send an identification request message 23. The appliance having the address ADD1 will reply to such message by turning its light indicator on and disabling the transmission of its address up to the next "general call" message, while the other appliances yet to be identified will continue to transmit their address.

At this point, the remote control receives another address ADD2, certainly different from the one previously stored, since the appliance already identified cannot transmit its address anymore. The remote control stores the second address and after a fixed time interval, for example in the order of one second, transmits a second identification request message 23 with address ADD2. Upon the reception of this message, the light indicator of the appliances having an address different from ADD2, in this case that with address ADD1, will turn off, since such appliances do not acknowledge themselves as recipients of the second message 23; the light indicator of the appliance having address ADD2 is turned on; the appliance having address ADD2 will disable the transmission of its address up to the next "general call" message; any other appliances yet to be identified will continue to transmit their address.

The last step of the procedure is repeated until the remote control has stored all sources located within its reception cone.

At that point, the remote control scans one by one the stored addresses, and sends identification request messages at suitable time intervals from one another. During this procedure, the user will see all light indicators of the appliances located within the remote control range of action turn on one by one.

Actually, the user must not necessarily wait for all appliances to reply to the call, but he can send the actuation command 24 when he sees the light indicator of the appliance he wants to control turned on.

It should also be noted that the scanning of the identified appliances must not necessarily be performed according to a timed sequence, but can be forced by the user if does not see the light indicator of the appliance he wants to control turn on, and can then request the remote control to go on to the next address present in the memory.

The address of the appliances is unique for each device and preset at the factory. However, this address is not necessarily used during all of the protocol steps. To shorten the messages (to prevent collisions, reduce the lengths of the messages and the energy absorbed by the remote devices) every remote device, upon a new "general call" message, could randomly generate a short address (for example, at 10 bits). The full protocol would initially be based on this address. When the remote control sends the identification request command, besides turning the light indicator on, the remote device also transmits its unique address fully. The remote control then uses this address to transmit the actuation command. Of course, there exists a probability (inversely proportional to the address fields size) that two or more devices located within the remote control cone of action take the same address. In this case, when the identification request command is sent, two or more devices will turn their light indicator on. If the user notices this, he can abort the communication procedure and start a new one. However, since this probability is very little (such as less than one out of one thousand), such contraindication may be acceptable.

From what said it is clear that, unlike the systems currently used, wherein the user must inform the remote control of the appliance he intends to control by pressing the corresponding keys or typing a code by an alphanumerical keypad provided on the remote control, in the system proposed herein the same remote appliances provide the remote control with the mode—in this case their address—for establishing a correct bi-univocal communication.

The only restraint to obtain this remote control mode relates to the reception angle of the remote control receiver, which must be sufficiently narrow so as to avoid as much as possible to repeat the procedure to be used in case more appliances are within the remote control cone of action.

It should be noted that an appliance can have a single receiver and multiple transmission devices located in different points of the same appliance: for example, an air conditioner may have the power adjustment commands address transmitter on the right and the air flow direction commands address transmitter on the left. By aiming to the left or to the right the user can therefore decide whether to adjust the air flow direction or the power.

Besides their address, the remote appliances can also transmit a coding of the type of actions they can perform (for example, switching between on and off, adjustment, switching between different modes, etc.) and/or a coding of their status (for example, the luminosity level of a lamp, speed of a fan, etc.). The same remote control could therefore be aimed in a sequence towards more appliances to store the addresses and the associated statuses. Such information will form the status of the environment or setting, or scenario. By providing a pushbutton panel capable of communicating with both the remote control and the remote appliances, it would be possible to associate all information relating to a scenario stored by the procedure described above, to a key of said panel. By acting on such key, the panel could therefore control one by one all appliances relating to the same scenario, obtaining the effect of recreating it. Such feature is not in se innovative, but the programming mechanism is. In fact, it provides for the following steps:

a) Using the remote control on the single appliances to create a scenario;

b) Acquiring from the appliances and by the remote control the information relating to their operating status; the set of such statuses will form the scenario;

c) Selecting a key of the panel to which such scenario is to be associated; and d) Sending the scenario-related information to the panel.

Finally, it should be noted that the remote control system proposed herein can be used in various applications, besides the traditional control of household appliances and electric systems. In fact, the control method and the base structure of the system components being understood, it is possible to easily add countless functions, thanks to simple hardware and/or software changes to be made to the remote control and/or to the remote appliances. For example, the remote control can be used to open/close doors by a password, as identification means (access control, cash dispenser, electronic signature, calculator password, library card, access to restricted access areas, etc.), to enable the use of a device in a fixed time interval, etc. Finally, the remote control can also know biometric data to ensure that its holder is also the owner, and therefore also serve as personal identification means.

The invention claimed is:

1. A remote control system for controlling appliances with a remote control, the system comprising:

a plurality of appliances, each appliance comprising a transmitter, said transmitter transmitting a first signal to the remote control;

a receiver, said receiver receiving and decoding a second signal from the remote control; and an identification address transmitted by the appliance transmitter, a remote control comprising a transmitter transmitting said second signal to each of said appliances;

a receiver having a defined receiver aiming axis, said receiver of said remote control receiving and decoding said first signal, said receiver including a directional receiving means for narrowing angle of reception of each transmitted first signal such that said receiver only receives one of said first signals when said receiver aiming axis is directed at said appliance transmitter, said directional receiving means being a vertex of a virtual conical channel, said virtual conical channel having a base directed towards one of said appliances for receiving said first signal of one of said appliances; and a key, said key sending an actuation command to a selected appliance when pressed.

2. Remote control system according to claim 1, wherein said directional receiving means of the remote control receiver is formed by a suitably shaped tube.

3. Remote control system according to claim 1, wherein said directional receiving means of the remote control receiver is a lens.

4. Remote control system according to claim 1, wherein said directional receiving means of the remote control receiver is formed by a collimation hole.

5. Remote control system according to claim 1, wherein the communication between said appliances and remote control is by infrared rays.

6. Remote control system according to claim 1, wherein the communication between said appliances and remote control is by infrared rays, whereas the communication between remote control and said appliances is by radiofrequency.

7. Remote control system according to claim 1, wherein at least one among appliances to be controlled and the remote control comprises a visual indication to to indicate that an appliance is controlled by said remote control.

8. A communication method for appliances with a remote control in a remote control system, the method comprising:

providing a plurality of appliances;

providing a remote control having a directional receiving means for receiving a signal from only one of said appliances, said directional receiving means being a vertex of a virtual conical channel, said virtual conical channel having a base directed towards one of said appliances for receiving said first signal of one of said appliances;

transmitting an identification signal from each appliance;

aiming said directional receiving means toward one of said appliances;

receiving and decoding the identification signal from only the aimed appliance via the remote control;

transmitting from the remote control a signal having an actuation command only for the aimed appliance.

9. Communication method according to claim 8, wherein the transmission of the identification message by the appliance occurs following an identification request transmitted by the remote control and received by all the appliances, comprising the one to be controlled, said identification request transmission being caused by a pressure of a key on the remote control by the user.

10. Communication method according to claim 8, further comprising:

transmitting via the remote control a signal for only the aimed appliance to be controlled, said signal containing a request of activation of a confirmation signal when the remote control is controlling the aimed appliance;

activating a signal via the aimed appliance when the remote control is controlling the aimed appliance.

11. Communication method according to claim 8, wherein the identification message sent by the aimed appliance to be controlled also contains an identification code of the type of action that said appliance is capable of actuating and a coding of its status.

12. A remote control system for controlling appliances with a remote control, the system comprising:

a first appliance including a first transmitter and a first receiver, said first transmitter emitting a first signal, said first signal including a first identification address;

a second appliance including a second transmitter and a second receiver, said second transmitter emitting a second signal, said second signal including a second identification address;

a remote control including a third transmitter, a third receiver and a key, said third receiver having a defined receiver aiming axis, said third receiver including a directional receiving means for narrowing angle of reception such that said directional receiving means only receives said first signal when said receiver aiming axis is directed at said first transmitter, said key sending an actuation signal to said first receiver when said receiver axis is directed at said first transmitter, said directional receiving means only receiving said second signal when said receiver aiming axis is directed at said second transmitter, said key sending said actuation signal to said second receiver when said receiver axis is directed at said second transmitter.

13. Remote control system according to claim 12, wherein said directional receiving means is formed by a suitably shaped tube.

14. Remote control system according to claim 12, where said directional receiving means is a vertex of a virtual conical channel, said virtual conical channel having a base directed towards said first appliance for receiving said first signal.

15. Remote control system according to claim 12, where said directional receiving means is a vertex of a virtual conical channel, said virtual conical channel having a base directed towards said second appliance for receiving said second signal.

* * * * *